US005307715A

United States Patent [19]

Smock

[11] Patent Number: 5,307,715

[45] Date of Patent: May 3, 1994

[54] ANGLE PUNCHING DIE ARRANGEMENT

[75] Inventor: Danny R. Smock, Pekin, Ill.

[73] Assignee: Caterpillar Inc., Peoria, Ill.

[21] Appl. No.: 938,093

[22] Filed: Aug. 31, 1992

[51] Int. Cl.[5] ..... B21D 28/32

[52] U.S. Cl. ..... 83/386; 83/588; 83/620; 83/693; 83/917

[58] Field of Search ..... 83/375, 382, 383, 456, 83/581, 582, 588, 590, 618, 620, 638, 693, 694, 917, 385, 386

[56] References Cited

U.S. PATENT DOCUMENTS

| | | | |
|---|---|---|---|
| 1,308,178 | 7/1919 | Kasel | 83/385 X |
| 3,215,017 | 11/1965 | Rutz | 83/917 X |
| 3,368,441 | 2/1968 | Piazze | 83/620 X |
| 3,405,583 | 10/1968 | Herzog | 83/693 X |
| 4,494,428 | 1/1985 | Malof | 83/693 X |
| 4,562,760 | 1/1986 | Kinsley | 83/693 |
| 4,569,263 | 2/1986 | Kravets | 83/581 X |

FOREIGN PATENT DOCUMENTS

| | | |
|---|---|---|
| 0484588A1 | 5/1992 | European Pat. Off. . |
| 3025552A1 | 1/1982 | Fed. Rep. of Germany . |
| 2824945C2 | 12/1983 | Fed. Rep. of Germany . |
| 3805846C1 | 6/1989 | Fed. Rep. of Germany . |
| 58-215229 | 12/1983 | Japan . |
| 61-7024 | 1/1986 | Japan . |
| 64-48627 | 2/1989 | Japan . |
| 2101511A | 1/1983 | United Kingdom . |

*Primary Examiner*—Eugenia Jones
*Attorney, Agent, or Firm*—Alan J. Hickman

[57] ABSTRACT

A punching arrangement has a guide assembly for guiding movement of a second die at an acute angle relative to a first die in order to punch an aperture at an acute angle in a flange of a track shoes. A positioning device moves the track shoe to a preselected location relative to the first die in response to movement of the second die toward the first die. A holding apparatus engages the track shoe and clamps the track shoe to the first die in response to further movement of the second die toward the first die. A crank mechanism breaks the second die away from binding engagement with the track shoe after punching and enables the second die to return to the initial position. The punching arrangement is particularly suited for use in a punching press.

14 Claims, 6 Drawing Sheets

ANGLE PUNCHING DIE ARRANGEMENT

DESCRIPTION

1. Technical Field

This invention relates generally to a an arrangement for punching an aperture in a member at an acute angle relative to a first side of the member, and more particularly to a die punching arrangement for positioning and holding a track shoe at a preselected location relative to a first die and for guiding angular movement of a second die relative to the first side of the track shoe.

2. Background Art

In the manufacture of track shoes for use on track type tractors and the like it is necessary to provide a pair of clearance notches in the leading edge of the shoe to avoid interference between the track and shoe as the track moves about the drive sprocket and idler wheels. To maximize the strength and surface area of the shoe the notches are disposed at an acute angle relative to a first side of the shoe.

It has been a past practice to cut the notches in the shoe with a cutting torch of conventional design and type. The cutting torch is robot controlled in order to maintain a reasonable degree of consistency in the cut between piece parts and to try and maintain the manufacturing tolerance of each notch within specification. This method of manufacture tends to be less accurate than desired and based on its limitations requires more lenient tolerances than desired. A tolerance range as large as 3 millimeters is not uncommon. Even with the lenient tolerances a substantial number of track shoes end up scrapped.

The time required to cut a notch in a track shoe using a cutting torch is substantial due to the thickness of the material being cut and variations in the material composition. As a result the finished track shoe is relatively expensive.

Machining of the track shoe by conventional methods, such as cutting the shoe to length and boring mounting bolt holes in the shoe, is done prior to heat treating. The notches are easiest burned in the shoe after heat treating. Thus, the desired sequence of operations, machining prior to heat treating, is not feasible.

Punching or piercing apertures normal to the surface of a steel material has been known for quite some time. However, no evidence has been found to hint or suggest the use of an apparatus for cold punching an aperture at an acute angle to a surface of a track shoe or other steel material.

The present invention is directed to overcoming one or more of the problems as set forth above.

DISCLOSURE OF THE INVENTION

In one aspect of the present invention, a die punching arrangement for punching an aperture in a steel member at an angle relative to a first side of the steel member is provided. The die punching arrangement has a die supporting base and a first die rigidly connected to said die supporting base. The first die has a supporting surface which is adapted to support a steel member to be punched. A second die is connected to a die carrier. The second die is matingly engageable with the first die. The first an second dies define a preselected configuration of an aperture to be punched in the steel member. A guide means is provided for slidably connecting the die carrier to the supporting base and guiding movement of the second die relative to the first die in directions transverse the steel member and along a die carrier axis oriented at a preselected acute angle "A" relative to the supporting surface of the first die during relative punching movement of the second die and the steel member.

A punching press having a die punching arrangement for punching an aperture in a flange of a track shoe at an acute angle relative to a first side of the track shoe is provided. The die punching arrangement includes a die supporting base having a raised portion and a guideway disposed in the raised portion. A load flange is movably connected to the die supporting base and movable in first and second opposite directions relative to the die supporting base. A first die having a supporting surface is connected to the die supporting base. The track shoe first side is supported on the track shoe supporting surface. A die carrier having a first guide member and being connected to the load flange. The first guide member is slidably disposed in the guideway and movably guided along a die carrier axis defined by the guideway in response to movement of the load flange in one of said first and second directions. A second die is connected to the carrier and movable with the carrier between a first position at which the second die is spaced from mating engagement with the the first die and a second position spaced from said first position at which said second die is in mating engagement with said first die. The track shoe is engaged to be punched by the second die in response to movement of the second die toward the second position. A positioning means connected to the load flange is provided for engaging the steel member and for urging slidable movement of the track shoe to a predetermined location on the first die supporting surface in response to movement of the load flange in the first direction toward the die supporting base.

The guide means which establishes the path of movement of the die carrier and maintains the carrier (and the second die) for angular movement relative to the first die facilitates the punching of the aperture (notch) on the preselected angle. Thus the shape and accuracy of the aperture being formed is kept to prescribed tolerance limits and the amount of scrap is reduced.

A positioning means engages the track shoe to be punched, just prior to punching and during the punching stroke. The positioning means accurately positions the track shoe at a preselected location relative to the first die so that the aperture being punched is at a desired location on the track shoe.

A holding means maintains the track shoe at the preselected location subsequent to positioning during the punching stroke so that the accuracy of aperture position is maintained. Since the positioning and holding means are facilitating accuracy of positioning of the track shoe during the punching stroke cycle time is kept to a minimum.

A coupling means connects the die carrier to the load flange and maintains the load flange and the die carrier for relative slidable movement in directions transverse die carrier and load flange axes during movement of the die carrier and load flange along the die carrier and load flange axes, respectively. Thus the coupling means reduces side loading of the guide means and associated componentry and promotes long life and smooth operation.

A crank means forces movement of the die carrier from the second position toward the first position and from binding engagement with the steel member (track shoe) in response to movement of the load flange. Thus, the load flange applies a breakaway force to the carrier to release the second die from engagement with the steel member. This isolates the coupling means from applying the breakaway force and reduces the potential for failure of the coupling means.

BEST MODE FOR CARRYING OUT THE INVENTION

Figure 7:
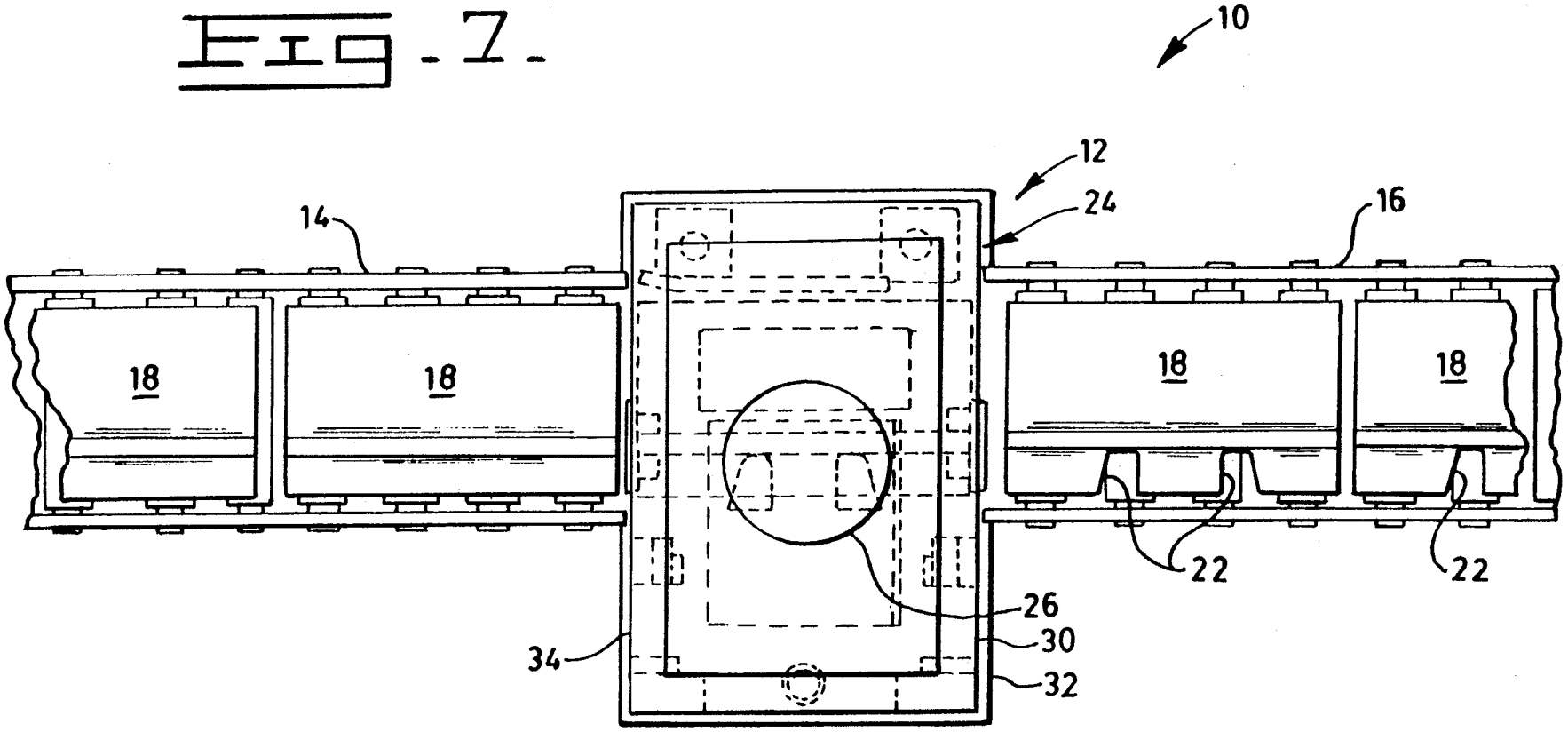
FIG. 7 is a diagrammatic top plan view of a partial manufacturing cell showing a press for punching track shoes and a conveyor line for transporting the track shoes.

With reference to the drawings, and particularly FIG. 7, a portion of a manufacturing cell 10 is generally shown. The cell 10 includes a punching press 12 and first and second conveyors 14, 16, preferably of the roller type, which delivers steel members 18, for example track shoes, to and from the punching press 12. The punching press 12, punches apertures 22, such as chain clearance notches of a preselected shape, at an angle to the steel member 18. A die punching arrangement 24 is provided to facilitate the punching of the apertures 22 in the steel members 18 as the steel members are fed to the punching press. The die punching arrangement 24 is operated by a ram 26 of the punching press 12 to apply a force of a predetermined magnitude based on factors such as the configuration of the aperture 22 to be punched, the composition of the material, the thickness of the steel member 18, and the angle at which the aperture 22 is to be punched. The ram 26 is of a conventional type and may be powered in any conventional manner such as hydraulically, mechanically, or electrically.

Referring to FIGS. 1-6, the die punching arrangement 24 for punching the aperture 22 in the steel member 18 at a preselected angle "a" relative to a first side 28 of the steel member 18 is shown. The preselected angle "a" is a function of the amount of clearance needed between the track shoe and the chain (not shown) to which the track is attached. It is to be noted that although the intended application is directed to punching angled notches in track shoes that other applications are within the scope and spirit of the invention. The die punching arrangement 24 has a die supporting base 30 which is supported on the bed 32 (FIG. 7) of the press 12 and a load flange 34 which is connected to the ram 26 and movable relative to the die supporting base 30 in a first direction toward the die supporting base 30 and in a second direction away from the die supporting base 30.

A first die 36 having a supporting surface 38 is rigidly connected to the die supporting base 30 in any suitable manner. Preferably, the first die 36 is connected to a die holder portion 40 of the die supporting base 30. The die holder portion 40 has a recess 42 in which the first die 36 is nested. The first die 36 is attached to the die holder portion 40 by threaded fasteners (not shown). The die holder portion 40 is secured to the die supporting base 30 by threaded fasteners 42.

A die carrier 44 is slidably movably connected to a raised portion 46 of the die supporting base 30 and movable relative to the die supporting base 30. A second die 50 is connected to the die carrier 44 in any suitable manner such as by threaded fasteners, not shown. The second die 50 is matingly engageable with the first die 36. The first and second dies define a preselected configuration of the aperture 22 to be punched in the steel member 18. Specifically, the second die 50 is a male die having a pair of punch portions 52 and the first die 36 is a female die having a pair of openings 54 for receiving the pair of punches 52 in a mating relationship. The punches 52 and the openings 54 are of substantially the same size and shape so that matable engagement therebetween and clean punching of the steel member 18 may be achieved. This configuration facilitates simultaneous punching of a pair of apertures 22 in the steel member 18.

Figure 3:
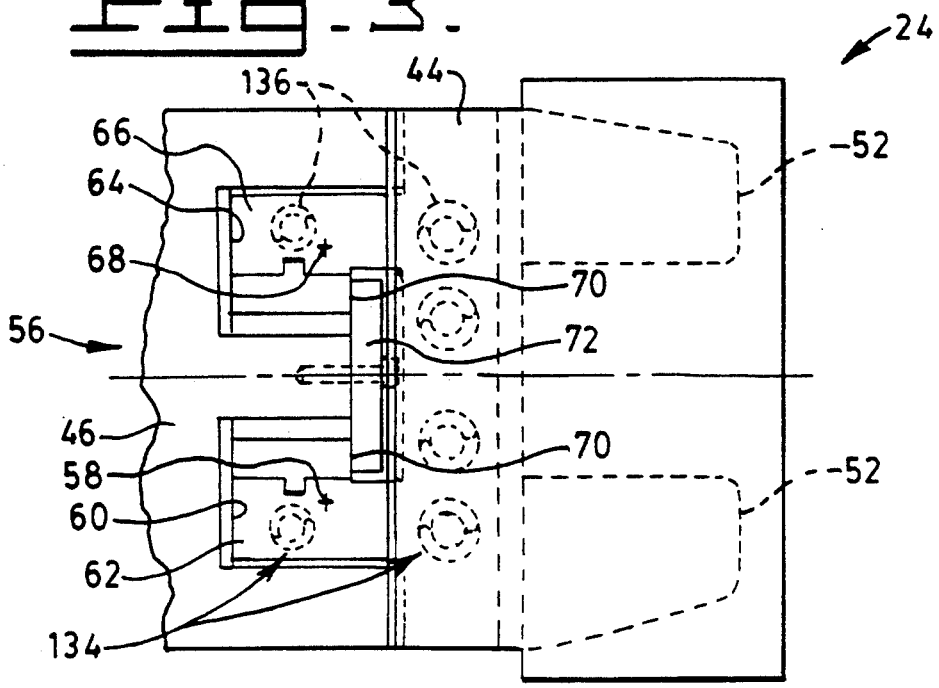
FIG. 3 is a diagrammatic cross section view taken along lines 3—3 of FIG. 1.
Figure 6:
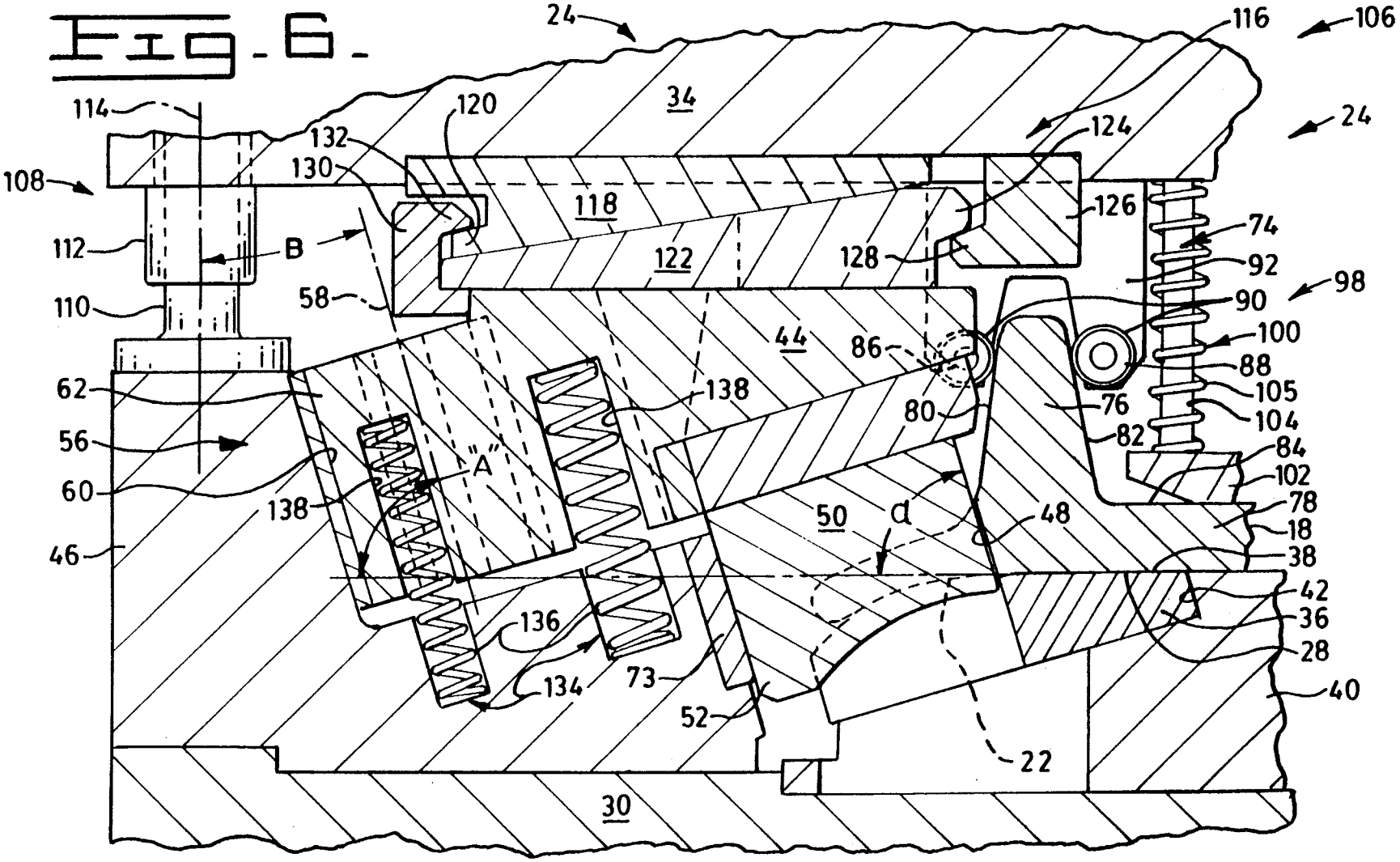
FIG. 6 is a diagrammatic cross section view taken along lines 6—6 of FIG. 2 with portions broken away to show the die punching arrangement in better detail.

As best seen in FIGS. 3 and 6, a guide means 56 slidably connects the die carrier 44 to the supporting base 30 and guides movement of the second die 50 relative to the first die 36 in directions transverse the steel member 18 and along a first die carrier axis 58 oriented at a preselected acute angle "A" relative to the supporting surface 38 of the first die 36 during relative punching movement of the second die 50 and the steel member 18. The acute angle "a" is substantially equal in magnitude to the acute angle "A" and the first die carrier axis 58 is substantially parallel to the angled side 48 of the aperture 22 during the punching operation. It is to be noted that the supporting surface 38 engages the first side 28 and thereby supports the steel member 18 to be punched thereon.

The guide means 56 includes a first guideway 60 disposed in the raised portion 46 of the die supporting base 30 and a first guide member 62 connected to the die carrier 44. The first guide member 62 is slidably guidably disposed in the first guideway 60 and movable in directions along the first die carrier axis 58.

The guide means 56 preferably but not necessarily includes a second guideway 64 disposed in the raised portion 46 of the die supporting base 30 and a second guide member 66 connected to the die carrier 44. The second guide member 66 is slidably guidably disposed in the second guideway 64 and movable in directions along a second die carrier axis 68 defined by the second guideway 64. The first and second guide members 62,66 are spaced apart and substantially parallel to each other. The first and second guideways 60,64 are also substantially parallel to each other and spaced apart a distance equal in magnitude to the magnitude of spacing between the first and second guide members 62,66. The first and second guide carrier axes 58,68 are also substantially parallel to each other.

The first and second guideways 60,64 are each defined by a rectangular shaped slot disposed in the raised portion 46 and the first and second guide members 62,66 are defined by a rectangular shaped guide block slidably disposed in the respective first and second guideways 60,64. The rectangular shaped slots as shown include a liner which is composed of a wear resistant bearing material of either the metallic or non-metallic type. The rectangular shaped guide blocks consist of two pieces fastened together such as by threaded fasteners (not shown).

The first and second guide members each have a bearing surface 70. A thrust member 72 is connected to the die supporting base and engageable with the bearing surface 70 of the first and second guide members 62,66. The thrust member 72 maintains the first and second guide members 62,66 for slidable axial movement in the first and second guideways 60,64 and resists cocking, tipping, and skewing of the die carrier 44 so that accurate punching of the steel member at angle "a" may be consistently provided.

The guide means 56 also has pair of flat supplemental thrust bearings 73 connected to the raised portion 46. The pair of supplemental thrust bearings 73 engage and support the pair of punches as the punches penetrate steel material 18 and generate the apertures 22.

The die carrier 44 is therefore guided by the guide means 56 for movement between a first position at which said second die 50 is spaced from mating engagement with the the first die 36 and a second position (FIG. 6) spaced from said first position at which said second die 50 is in matingly engaged with the first die 36.

A positioning means 74, connected to the load flange 34, engages the steel member 18 and urges movement of the steel member 18 to a predetermined location relative to the first die 36 in response to movement of the load flange 34 in the first direction toward the die supporting base 30.

The steel member has a rib 76 and a flange 78. The rib 76 has first and second sides 80,82 spaced at an angle to each other. The flange 78 has the aforementioned first side 28 and a second side 84 spaced from the first side. The rib 76 is connected to and extends from the flange second side 84.

Figure 4:
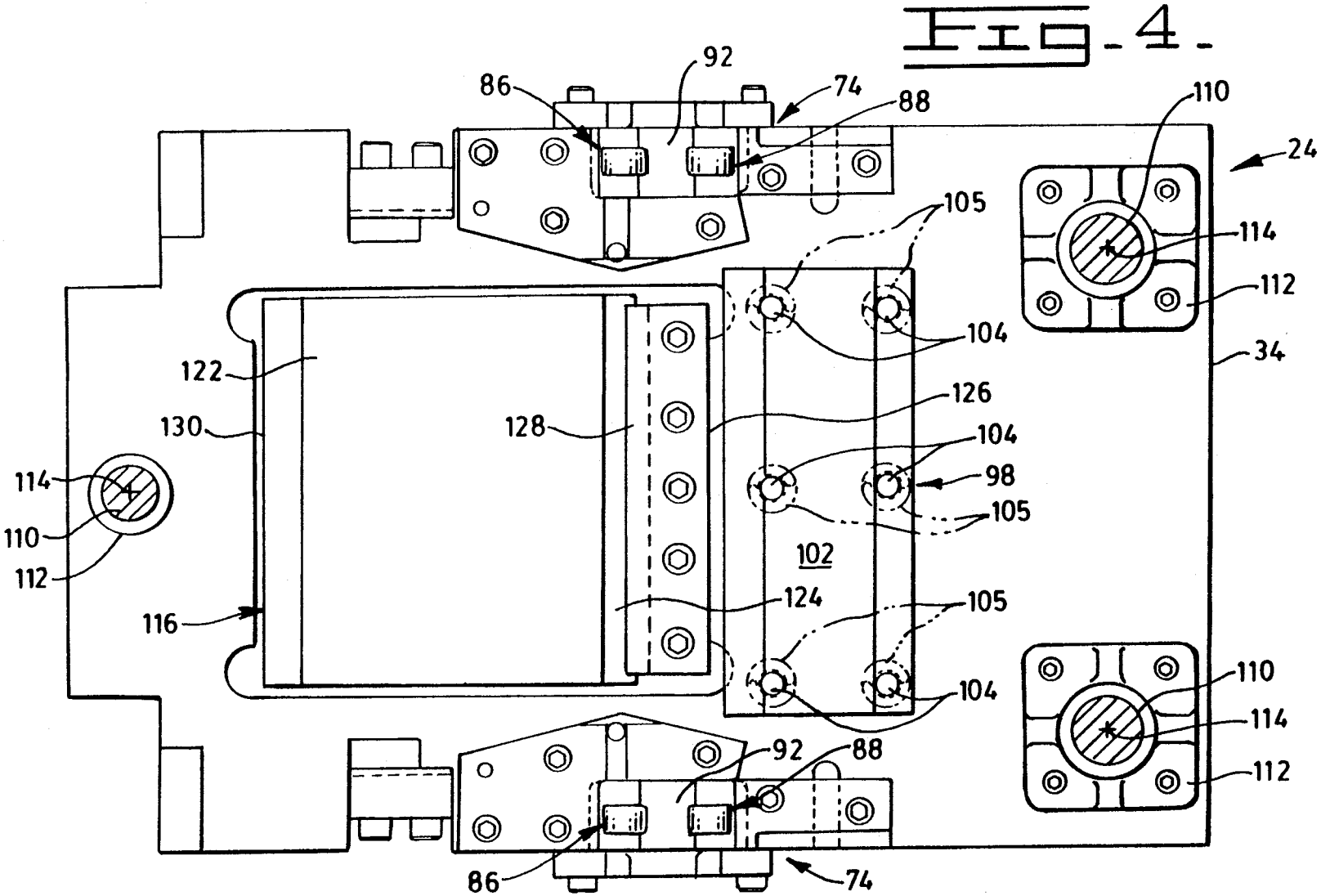
FIG. 4 is a diagrammatic cross section view generally taken along lines 4—4 of FIG. 1 with portions removed to show a load flange and a coupling means in detail.
Figure 5:
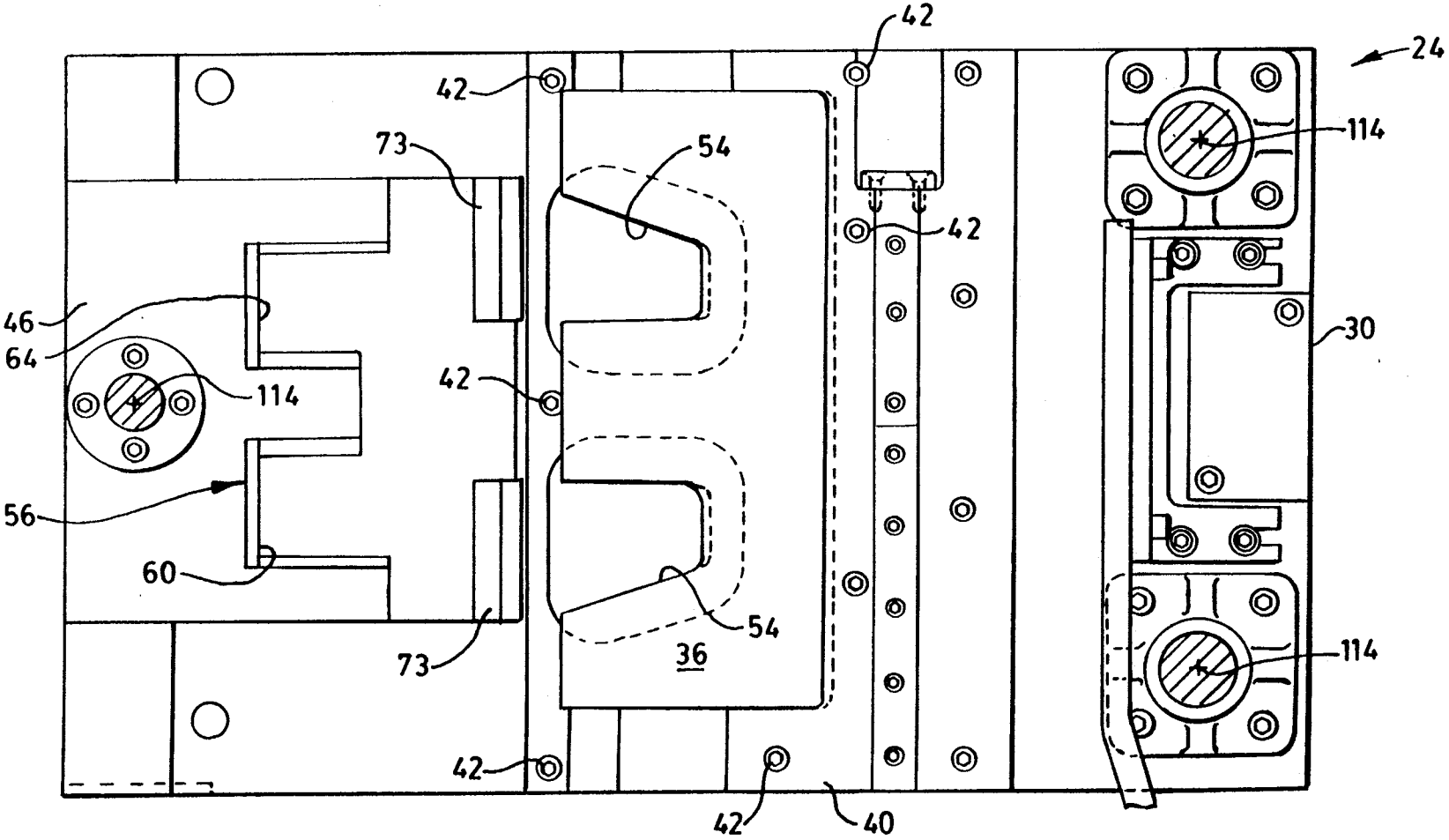
FIG. 5 is a diagrammatic cross section view generally taken along lines 5—5 of FIG. 1 showing the die supporting base and first die in detail.

The positioning means 74 has first and second bearing portions 86,88 movably connected to the load flange 34. The first and second bearing portions 86,88 are engageable with the rib first and second sides 80,82, respectively, at the second position of the die carrier 44. Preferably, the first and second bearing portions 86,88 include rollers 90 which are rotatively connected to a grooved member 92 movably connected to the load flange 34. As shown in FIG. 4, a pair of positioning means 74 are provided, one adjacent each opposite side of the load flange 34.

Figure 1:
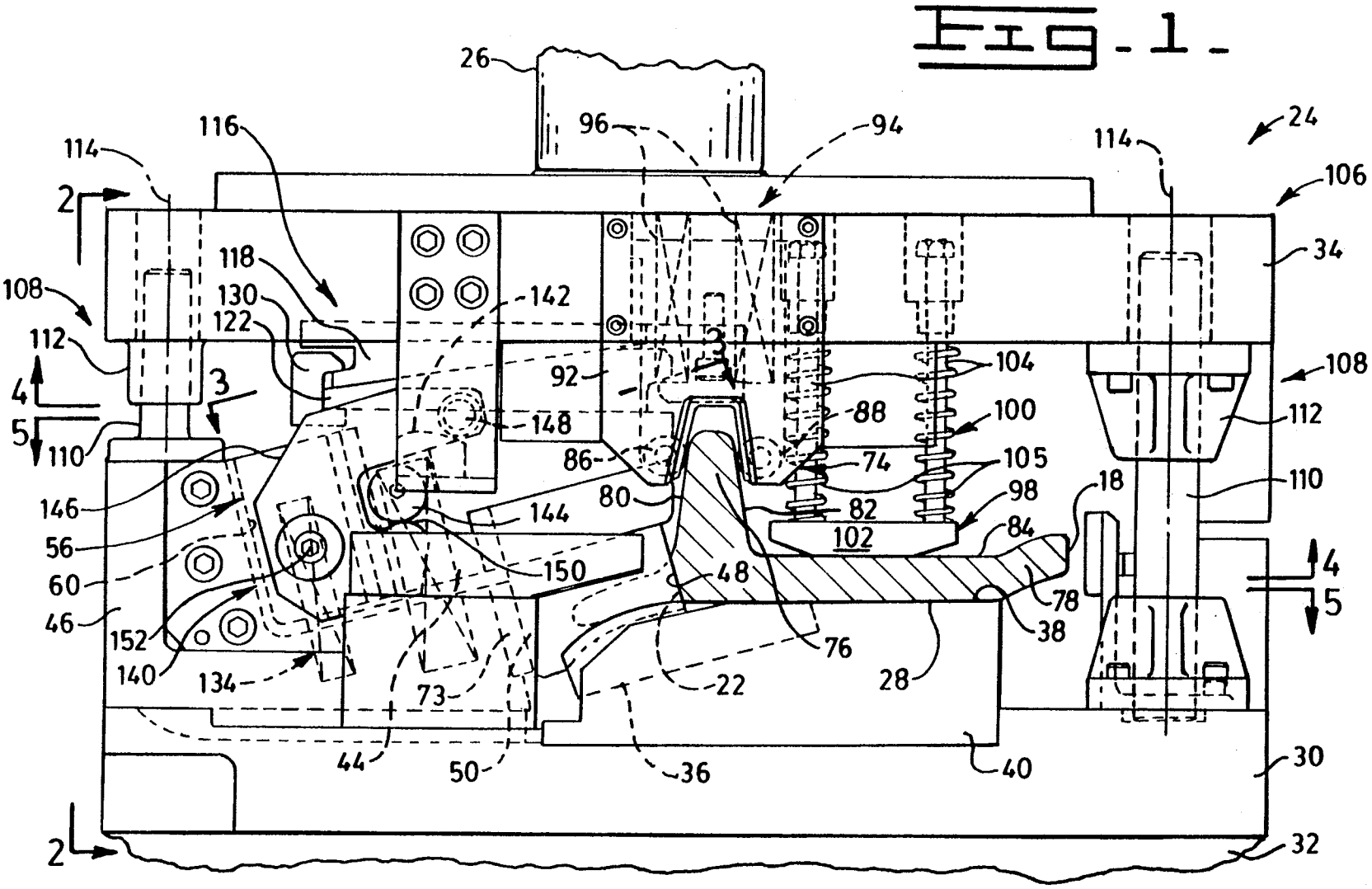
FIG. 1 is a diagrammatic side elevational view of an embodiment of the present invention disclosing a die punching arrangement for punching an angled aperture in a steel member.

As best seen in FIG. 1, the positioning means 74 includes spring means 94 (FIG. 1) for biasing the first and second bearing portions 86,88 in a direction toward the first die 36. Specifically, a pair of coil springs 96 associated with the load flange 34 engages the grooved member 92 and urges the grooved member toward the die supporting base 30. The spring means 94 maintains a preselected force against the steel member 18 and accommodates a range of steel member 18 sizes. The positioning of the steel member 18 by the positioning means 74 is achieved during movement of the load flange 34 from the first position toward the second position and prior to punching of the steel member 18.

Referring to FIGS. 1,4,6, a holding means 98 movably connected to the load flange 34 is provided for engaging the second side 84 of the steel member 18 and for maintaining said steel member 18 at the aforementioned predetermined location during at least a portion of the movement of said die carrier 44 between the first and second positions. A biasing means 100 biases the holding means 98 in a direction toward the first die 36 and maintains the holding means 98 in engagement with the second side 84 of the said steel member 18. The biasing means 100 applies a force to the steel member 18 of a magnitude sufficient to maintain the steel member 18 from movement relative to the first die 36 during movement of the die carrier 44 between the first and second positions.

The holding means 98 has a foot member 102 and a plurality of rods 104 slidably connected to the load flange 34. The biasing means 100 includes a coil spring 105 disposed about each of the plurality of rods 104 and disposed between and engageable with the load flange 34 and the foot member 102. Since each of the holding means 98 and positioning means 74 are biased for movement relative to the load flange 34 different steel member 18 sizes and configurations are readily accommodated.

A load means 106 applies a force to the die carrier and moves the second die 50 into a mating engagement with said first die. The load means 106 includes the load flange 34 and a load flange guide means 108 for guiding linear movement of the load flange 106 directions transverse the base. The load flange guide means 108 includes a plurality of guide rods 110 and a guide sleeve 112 slidably disposed about each of the plurality of the guide rods 110. The guide sleeves 112 are connected to the load flange 34 and the guide rods 110 are connected to the die supporting base 30. The load flange guide means 108 defines a load flange guide axis 114, the linear path that the load flange 34 follows during movement in the first and second directions. The load flange guide axis 114 is at a preselected angle "B" to the die carrier axis 58 and substantially normal to the supporting surface portion 38 and the die supporting base 30.

A coupling means 116 connects the die carrier 44 to the load flange 34 and maintains the load flange 34 and the die carrier 44 for relative slidable movement in directions transverse the die carrier and load flange axes 58,114 during movement of the die carrier 44 and load flange 34 along the die carrier and load flange axes 58,114, respectively. The coupling means 116 includes a first wedge shaped member 118 having a lip 120 and being connected to the load flange 34 in any suitable manner such as by threaded fasteners (not shown). The coupling means 116 also includes a second wedge shaped member 122 having a lip 124 and being connected to the die carrier 44 in any suitable manner such as by threaded fasteners (not shown). The second wedge shaped member 122 is slidably engaged with the first wedge shaped member 118. A first hooking flange 126 having a lip 128 is connected to the load flange 34 and a second hooking flange 130 having a lip 132 is connected to the die carrier 44. The first hooking flange lip 128 is engageable with the second wedge shaped member lip 124 and the second hooking flange lip 132 is engageable with the first wedge shaped member lip 120. Because of the sliding wedge geometry undesirable side forces acting transverse the guide carrier axes 58,68 are substantially reduced. Thus smooth movement of the die carrier 44 during the punching operation is provided.

Referring in particular to FIGS. 1, 3 and 6, a spring means 134 urges movement of the die carrier 44 from the second position toward the first position. The spring means 134 is disposed between the die carrier 44 and the die supporting base 30. Specifically, the spring means 134 includes a plurality of coil springs 136 disposed in parallel spaced apart blind bores 138 oriented parallel to the first die carrier axis 58.

Figure 2:
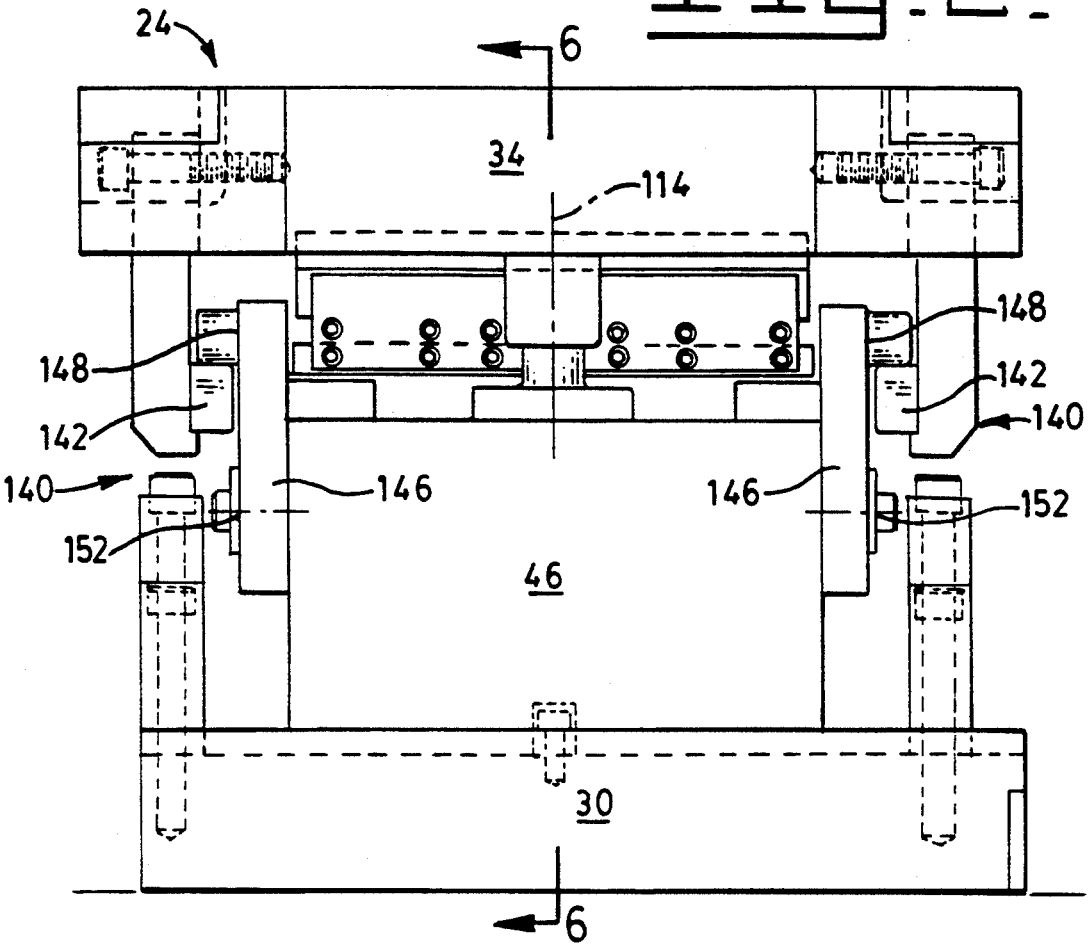
FIG. 2 is a diagrammatic end view taken along lines 2—2 of FIG. 1.

Referring to FIGS. 1 and 2, a crank means 140 is provided for forcing movement of the die carrier 44 from the second position toward the first position and from binding engagement with the steel member 18 in response to movement of the load flange 34 in the second direction. The crank means 140 relieves the coupling means 116 from heavy loading due to binding and the like of the die carrier 44 and the second die 50 during movement of the load flange 34 in the second direction and thus increases coupling means life. The crank means 140 includes a cam 142 connected to the load flange 34, a bearing member 144 connected to the carrier and a lever 146 having first and second end portions 148,150 and a middle portion 152 located between the first and second end portions 148,150. The lever 146 has a hook shaped configuration and is pivotally connected at the middle portion 152 to the raised portion 46 of the die supporting base 30. The lever 146 is engageable at the first end portion 148 with the cam 142 and engageable at the second end portion 150 with the bearing member 144. The engagement at the first end portion 148 with the cam 142 is through a roller mounted on the first end portion 148. The lever 146 is pivotal at the middle portion 152 in response to movement of the load flange 34 in the second direction, engages the bearing member 144, and urges the die carrier 44 toward the first position. The pivotal connection at the middle portion 152 to the raised portion 46 is by any conventional pivot pin arrangement. The particular shape of the lever 146 determines the operational characteristics of the crank means affects the timing of the die carrier 44 release. It should be noted that a pair of spaced apart crank means 140 are provided, as shown in FIG. 2, to eliminate the potential for cocking, binding and the like of the die carrier 44 and guide means 56.

Industrial Applicability

With reference to the drawings, and in operation, the steel material is fed by the first conveyor 14 to the punch press 12 to a location between the load flange 34 and the die supporting base 30. The ram 26 of the punch press forceably moves the load flange 34 in the first direction and forces the die carrier 44 to move toward the flange 78 of the steel member 18. During this movement the positioning means 74 engages the rib 76 of the steel member 18 and moves the rib 76 to nestle between the first and second bearing portions 86,88 of the positioning means 74. This movement results in the positioning of the steel member 18 to a preselected location on the first die 36, a location at which the apertures 22 may be accurately punched. The spring means 94 limits the force applied by the positioning means 74 to a preselected maximum and permits further movement of the load flange 34 in the first direction subsequent to the positioning process of the steel member 18. The positioning means 74 serves to provide a limited degree of restraint of the steel member 18 and holds the steel member 18 in position.

Subsequent to the accurate positioning of the steel member 18 on the first die 36, but prior to engagement between the steel plate 18 and the second die 50, the holding means 98 engages the second side 84 of the flange 78 and forces the steel member 18 into clamping engagement with the supporting surface 38 of the first die 36. The load applied by the holding means 98 to the steel plate 18 is sufficient to maintain the steel plate 18 at the preselected location and from inadvertent movement during punching.

After the steel member 18 is securely held in place and during continuous subsequent movement of the load flange 34 in the first direction, the second die 50 engages the steel member 18 and punches the apertures 22 in the steel member 18 at the desired locations. The second die 50 during this stage of movement moves into mating engagement with the first die 36. The coupling means 116 and the guide means 56 insures smooth and accurate movement of the second die 50 relative to the first die 36 and efficient transfer of forces from the ram 26 to the second die 50.

Once the first and second dies 36,50 are in mating engagement and the apertures 22 are punched in the steel member 18 the direction of the ram 26 is reversed. Upon this reversal the load flange 34 moves in the second direction and returns the second die 50 from the second position at which the dies are in mating engagement to the first position spaced therefrom. Due to the angle ("a") of movement of the second die 50 relative to the steel member 18 binding of the second die 50 may occur. To positively loosen the second die 50 from the steel member 18 the crank means 140 is provided. By way of movement of the cam 142 with the load flange, the cam 142 engages the lever 146 and causes the lever 146 to pivot. The lever mechanically forces the bearing member 144 to move the die carrier 44 along the first die carrier axis 58. Once the second die 50 is broken loose the spring means 134 moves the second die 50 to the first position as the load flange 34 moves in the second direction.

The second conveyor 16 delivers the punched steel member 18 from the punching press 12 to a storage location, another manufacturing machine, or to a heat treating furnace.

Other aspects, objects and advantages of the present invention can be obtained from a study of the drawings, the disclosure and the appended claims.

I claim:

1. A die punching arrangement for punching an aperture in a steel member at an angle "a" relative to a first side of a flange of the steel member, comprising:

a die supporting base;

a first die having a supporting surface and being rigidly connected to said die supporting base, said supporting surface being adapted to support a steel member to be punched;

a die carrier movable relative to the supporting base;

a second die connected to said die carrier, said second die being matingly engageable with the first die, said first and second dies defining a preselected configuration of an aperture to be punched in the steel member;

guide means for slidably connecting the die carrier to the supporting base and guiding movement of said second die relative to the first die in directions transverse to the steel member and along a first axis oriented at a preselected acute angle "A" relative to the supporting surface of the first die during relative punching movement of the second die and the steel member;

a load flange spaced from said die supporting base and movable in directions toward and away from said die supporting base, said die carrier being movable between a first position at which said second die is spaced from mating engagement with the the first die and a second position spaced from said first position at which said second die is in mating engagement with said first die;

positioning means for engaging the steel member and urging movement of the steel member to a predetermined location relative to the first die in response to movement of the load flange toward the die supporting base, said positioning means being connected to said load flange, said steel member having a rib, said rib having first and second sides and said flange of said steel member having a second side, said rib being connected to and extending from the flange second side, said positioning means having first and second bearing portions, said first and second bearing portions being engageable with the rib first and second sides, respectively, at the second position of the die carrier.

2. A die punching arrangement, as set forth in claim 1, including:

holding means for engaging the steel member and maintaining said steel member at said predetermined location during at least a portion of the movement of said die carrier between the first and second positions, said holding means being connected to said load flange.

3. A die punching arrangement, as set forth in claim 2, including means for biasing said holding means in a direction toward said first die, maintaining said holding means in engagement with said steel member, and maintaining said steel member from movement relative to the first die during movement of the die carrier in directions between said first and second positions.

4. A die punching arrangement, as set forth in claim 3 wherein said holding means includes a foot member and a rod slidably connected to said load flange, said biasing means including a spring disposed between and engageable with the load flange and the foot member.

5. A die punching arrangement, as set forth in claim 1, including a spring means for biasing the first and second bearing portions in a direction toward the first die.

6. A die punching arrangement for punching an aperture in a steel member at an angle "a" relative to a first side of the steel member, comprising:

a die supporting base;

a first die having a supporting surface and being rigidly connected to said die supporting base, said supporting surface being adapted to support a steel member to be punched;

a die carrier movable relative to the supporting base;

a second die connected to said die carrier, said second die being matingly engageable with the first die, said first and second dies defining a preselected configuration of an aperture to be punched in the steel member;

guide means for slidably connecting the die carrier to the supporting base and guiding movement of said second die relative to the first die in directions transverse to the steel member and along a first axis oriented at a preselected acute angle "A" relative to the supporting surface of the first die during relative punching movement of the second die and the steel member;

a load flange connected to and movable along a load flange guide axis oriented transversely relative to the die supporting base and at an angle "B" relative to the die carrier axis; and coupling means for connecting the die carrier to the load flange and maintaining the load flange and the die carrier for relative slidable movement in directions transverse to the die carrier and load flange axis during movement of the die carrier and load flange along the die carrier and load flange axes, respectively, said coupling means including a first wedge shaped member having a lip and being connected to the load flange, a second wedge shaped member having a lip and being connected to the die carrier, said second wedge shaped member being slidably engaged with the first wedge shaped member, a first hooking flange having a lip and being connected to the load flange, and a second hooking flange having a lip and being connected to the die carrier, said first hooking flange lip being engageable with the second wedge shaped member lip and said second hooking flange lip being engageable with the first wedge shaped member lip.

7. A die punching arrangement for punching an aperture in a steel member at an angle "a" relative to a first side of the steel member, comprising:

a die supporting base;

a first die having a supporting surface and being rigidly connected to said die supporting base, said supporting surface being adapted to support a steel member to be punched;

a die carrier movable relative to the supporting base;

a second die connected to said die carrier, said second die being matingly engageable with the first die, said first and second dies defining a preselected configuration of an aperture to be punched in the steel member;

guide means for slidably connecting the die carrier to the supporting base and guiding movement of said second die relative to the first die in directions transverse to the steel member and along a first axis oriented at a preselected acute angle "A" relative to the supporting surface of the first die during relative punching movement of the second die and the steel member;

a load flange movably connected to the die supporting base and movable in a first direction toward said supporting base and a second direction opposite said first direction;

crank means for forcing movement of the die carrier from a second position at which said second die is in mating engagement with said first die toward a first position at which said second die is spaced from mating engagement with said first die and from binding engagement with the steel member in response to movement of the load flange in said second direction, said crank means including a cam connected to said load flange, a bearing member connected to said carrier, and a lever having first and second end portions and a middle portion located between the first and second end portions, said lever being pivotally connected at the middle portion to the die supporting base, engageable at the first end portion with the cam and engageable at the second end portion with the bearing member, said lever being pivotal at the middle portion in response to movement of the load flange in the second direction to engage the bearing member and urge the die carrier toward the first position.

8. A die punching arrangement for punching an aperture in a steel member at an angle "a" relative to a first side of the steel member, comprising:

a die supporting base;

a first die having a supporting surface and being rigidly connected to said die supporting base, said supporting surface being adapted to support a steel member to be punched;

a die carrier movable relative to the supporting base;

a second die connected to said die carrier, said second die being matingly engageable with the first die, said first and second dies defining a preselected configuration of an aperture to be punched in the steel member;

guide means for slidably connecting the die carrier to the supporting base and guiding movement of said second die relative to the first die in directions transverse to the steel member and along a first axis oriented at a preselected acute angle "A" relative to the supporting surface of the first die during relative punching movement of the second die and the steel member;

a load flange movably connected to the die supporting base and movable in a first direction toward said supporting base and a second direction opposite said first direction; and crank means pivotally connected to the die supporting base for forcing movement of the die carrier from a second position at which said second die is in mating engagement with said first die toward a first position at which said second die is spaced from mating engagement with said first die and said second die from binding engagement with the steel member in response to movement of the load flange in said second direction.

9. A punching press having a die punching arrangement for punching an aperture in a flange of a track shoe at an acute angle "a" relative to a first side of the track shoe; comprising:

a die supporting base having a raised portion;

a guideway disposed in the raised portion;

a load flange being movably connected to the die supporting base and movable in first and second opposite directions relative to the die supporting base;

a first die having a supporting surface and being connected to the die supporting base, said track shoe first side being supported on the supporting surface of the first die;

a die carrier having a first guide member and being connected to the load flange, said first guide member being slidably disposed in the guideway and movably guided along a die carrier axis defined by the guideway in response to movement of the load flange in one of said first and second directions;

a second die connected to the carrier and movable with the carrier between a first position at which said second die is spaced from mating engagement with the first die and a second position spaced from said first position at which said second die is in mating engagement with said first die, said track shoe being engaged to be punched by the second die in response to movement of the second die toward the second position;

positioning means for engaging the track shoe and urging slidable movement of the track shoe to a predetermined location on the die supporting surface in response to movement of the load flange in the first direction toward the die supporting base, said positioning means being connected to the load flange; and crank means for forcing movement of the die carrier from the second position toward the first position and from binding engagement with the track shoe in response to movement of the load flange in one of the first and second directions.

10. A punching press, as set forth in claim 9, including holding means for engaging the track shoe and maintaining said track shoe at said predetermined location during at least a portion of the movement of said die carrier between the first and second positions, said holding means being connected to said load flange.

11. A punching press, as set forth in claim 9, including coupling means for connecting the die carrier to the load flange and maintaining the die carrier for relative slidable movement in directions transverse to the first and second directions of movement of the load flange during movement of the second die between the first and second positions.

12. A punching press, as set forth in claim 9, including load flange guide means for guiding linear movement of the load flange in directions normal to the base and at an acute angle "B" to the die carrier axis.

13. A die punching arrangement for punching an aperture in a steel member at an angle "a" relative to a first side of the steel member, comprising:

a die supporting base;

a first die having a supporting surface and being rigidly connected to said die supporting base, said supporting surface being adapted to support a steel member to be punched;

a die carrier movable relative to the supporting base;

a second die connected to said die carrier, said second die being matingly engageable with the first die, said first and second dies defining a preselected configuration of an aperture to be punched in the steel member; and guide means for slidably connecting the die carrier to the supporting base and guiding movement of said second die relative to the first die in directions transverse to the steel member and along a first axis oriented at a preselected acute angle "A" relative to the supporting surface of the first die during relative punching movement of the second die and the steel member, said guide means including a first guideway disposed in one of said die carrier and die supporting base and a second guideway disposed in said one of the die carrier and die supporting base, said second guideway being spaced from said first guideway, a first guide member connected to the other of said die carrier and die supporting base and a second guide member connected to said other of said die carrier and die supporting base, said second guide member being spaced from the first guide member, said first guide member being slidably guidably disposed in the first guideway and movable in directions along the first axis and said second guide member being slidably guidably disposed in the second guideway and movable along a second axis oriented transversely relative to said supporting surface at the acute angle "A" and substantially parallel to the first axis, said first and second guide members each having a bearing surface, and a thrust member connected to the die supporting base and engaging said bearing surfaces of the first and second guide members, said thrust member maintaining said first and second guide members for slidable axial movement in the first and second guideways, respectively.

14. A die punching arrangement, as set forth in claim 13, said first die having a pair of spaced opening disposed therein and said second die having a pair of spaced punches, said pair of spaced punches being disposable in the pair of spaced openings.

* * * * *